US006401812B2

(12) United States Patent
Leising

(10) Patent No.: US 6,401,812 B2
(45) Date of Patent: Jun. 11, 2002

(54) METHOD AND APPARATUS FOR MULTILATERAL WELL ENTRY

(75) Inventor: Lawrence J. Leising, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/908,949

(22) Filed: Jul. 19, 2001

Related U.S. Application Data

(63) Continuation of application No. 09/410,153, filed on Sep. 30, 1999, now Pat. No. 6,349,768.

(51) Int. Cl.[7] ..... E21B 23/04; E21B 47/00

(52) U.S. Cl. ..... 166/117.6; 166/50; 166/255.2; 166/383

(58) Field of Search ..... 166/56, 313, 117.5, 166/117.6, 255.2, 255.3, 381, 383

(56) References Cited

U.S. PATENT DOCUMENTS 2,696,264 A * 12/1954 Colmerauer et al. ..... 166/235
2,948,341 A * 8/1960 Fredd ..... 166/117.5
3,796,259 A * 3/1974 Outhouse ..... 166/117.5
4,031,954 A * 6/1977 Herbert et al. ..... 166/117.5
4,763,734 A * 8/1988 Dickinson et al. ..... 175/61
5,415,238 A * 5/1995 Nice ..... 166/381

* cited by examiner

*Primary Examiner*—David Bagnell
*Assistant Examiner*—Jennifer H Gay
(74) *Attorney, Agent, or Firm*—Fred G. Pruner, Jr.; Wayne I. Kanak

(57) ABSTRACT

In one embodiment, the invention relates to a method for location, or location and entry, of a lateral wellbore from a main wellbore of a multilateral hydrocarbon well, the method being characterized by unique operation of a controllably bent sub. The invention further relates to a system for location, or location and entry of a lateral wellbore, including a specialized controllably bent sub, and most preferably, to a controllably bent sub designed for efficient lateral wellbore location and/or entry.

4 Claims, 11 Drawing Sheets

VIEW A-A

SECTION B-B

SECTION C-C

SECTION D-D

SECTION E-E

METHOD AND APPARATUS FOR MULTILATERAL WELL ENTRY

This application is a continuation of U.S. patent application Ser. No. 09/410,153, filed on Sep. 30, 1999 now U.S. Pat. No. 6,349,768.

FIELD OF THE INVENTION

The invention relates generally to the location and entry of a lateral hydrocarbon well from a main wellbore in a subterranean formation, and additionally to treatment and/or analysis of a lateral hydrocarbon well after such location and entry.

BACKGROUND OF THE INVENTION

Multilateral hydrocarbon wells, i.e., hydrocarbon wells having one or more secondary wellbores connecting to a main wellbore, are common in the oil industry, and will continue to be drilled in substantial numbers in the future. Location, or location and entry of one or more of the secondary or lateral wellbores, whether in completion or treatment procedures for a new well, or for reconditioning or reworking of an older well, often poses a problem for the well service operator.

A common approach for location and entry into lateral wellbores, particularly in level 1 and level 2 well construction, is to run jointed pipe from a service rig just barely into the lateral wellbore using standard location and kickoff procedures. Coilable tubing (commonly referred to in the industry as "coiled tubing") carrying a service or work tool is then run through the jointed pipe and into the lateral wellbore. In the usual approach, however, the extra expense of a service rig adds significantly to the cost of entry operations. Again, in some cases, even if the cost of the service rig is accepted, procedures employed for location of a particular lateral wellbore often lack precision and can be time consuming. Accordingly, efforts have continued, and there has been a need, to find an alternative to service rig dependent and inefficient approaches, particularly for level 1 and level 2 multilateral well reworking operations. In particular, there has been a need to provide an effective location or location and entry method and a locator, entry and servicing tool that would reduce costs and allow use of relatively inexpensive coiled tubing procedures. The invention addresses these needs, and provides a method, system, and tool for location, entry or re-entry, and service operations, each of which is particularly adapted to "coiled tubing" usage.

SUMMARY OF THE INVENTION

Accordingly, in one embodiment, the invention relates to a method for location, or location and entry, of a lateral wellbore from a main wellbore of a multilateral hydrocarbon well, the method being characterized by unique operation of a controllable or controllably bent sub. In this embodiment, the working tool employed, including the aforementioned sub, which possesses particular required positioning and/or deflection characteristics, is operated in the main wellbore in a manner such that location of the desired lateral wellbore is facilitated. For conducting wellbore treatment or servicing, the work tool will comprise well treatment and/or analysis components, optionally in the "bent" segment or arm of the sub. Advantageously, with well treatment and/or analysis components provided in or near the sub, the invention permits immediate treating operations in the located lateral wellbore, tripping out and removal of the sub being unnecessary.

In a further aspect, the invention relates to a novel system for location or location and entry of a lateral wellbore from a main wellbore of a hydrocarbon well, and which further includes means for working or reworking the well, the system comprising a work string and a unique wellbore working tool suspended on the work string. The novel working tool terminates in a segmented work-locator sub having a terminal segment which may be "bent" according to predetermined design requirements. In particular, the work-locator sub of the system is adapted to semi-rigidly or semi-flexibly position its terminal segment or semi-rigidly or semi-flexibly deflect its terminal segment at an acute angle with respect to the longitudinal axis of the string or other segment of the sub, the terminal segment further being of a length adapted for lateral wellbore incursion. The terms "semi-rigidly" and "semi-flexibly", as utilized herein with respect to the positioning or deflection of the sub terminal segment, are understood to indicate a relative rigidity at which the directing or positioning components of the sub are designed to maintain the position of or deflection of the sub's terminal segment. This degree of rigidity is unlike the rigidity or stiffness at which common controllable bent subs are held during drilling operations. Instead, the sub of the system is structurally adapted for, or comprises structural components for, positioning the terminal segment with sufficient rigidity for efficient wellbore entry, as hereinafter described, while providing the capacity for, when the terminal segment is deflected from the longitudinal axis of the string or other segment of the sub, limited yield of deflection to a predetermined force or constraint or to a reduction of the angle of deflection in response to encounter of such force or contraint, or to an increase or expansion of the angle of deflection in the absence or elimination of such force or constraint. Accordingly, when the terminal segment is "straight", i.e., at least a section thereof is in or generally in a line coincident with the longitudinal axis of the remainder of the sub or the string, the sub's terminal segment positioning components will be designed to hold the terminal segment with sufficient rigidity or firmness that the terminal segment does not pendulate or "dangle" to any significant extent due to gravity from the rest of the sub, a firmness important, for example, in wellbore entry, advancement, or retrieval. In the deflected posture of the terminal segment, the positioning components of the sub will be designed not only to provide the terminal segment with a certain moment to deflect or position and maintain the segment in deflection, but will be adapted to yield somewhat to the wellbore wall's constraint, to adjust to a limited increase of the angle of deflection upon removal of any constraining force on the terminal segment, or to the decrease of or reduction of the angle upon encounter by the terminal segment with a constraining force exceeding a pre-determined level. Thus, for example, the sub components are adapted or structured, on one hand, to maintain its terminal segment securely against the main wellbore wall, even though constrained thereby to some extent from further deflection, while, on the other hand, if the terminal segment is further or fully deflected during open lateral wellbore entry, being adapted for constraint and reduction of the degree of deflection to some degree, if, for example, the work tool is raised and the terminal segment again encounters the constraining wall of the main wellbore. To accomplish this type of resilient positioning or deflection, appropriate means are provided in the sub, as hereinafter described. Again, as utilized herein, the phrase "of a length adapted for lateral wellbore incursion" indicates that, in sizing the terminal segment for use in a main wellbore of specified width, the length of the terminal segment is sized to that length effective to protrude or project a section of the terminal segment into a lateral wellbore if the deflection angle between the longitudinal axis of the string or remainder of the sub and the longitudinal axis of the terminal segment is increased from the deflection angle determined by the intersection of the longitudinal axis of the string or remainder of the sub and the terminal segment when confined by a main wellbore wall. Importantly, the terminal segment of the work-locator sub of the system, in its most preferred aspect, further comprises means for well treatment and/or analysis so that, once the lateral wellbore is located and entered, the lateral may be worked, treated and/or measurements taken without withdrawal of the sub. Finally, means for orienting the work-locator sub in the wellbore and means cooperating with the work-locator sub for signaling the location of a lateral wellbore are provided in the system.

In a further particular aspect, the invention comprises a work tool which is adapted for performance in the invention method and which includes a combination of elements including a novel segmented work-locator apparatus or sub. In this embodiment, the novel segmented work-locator apparatus comprises a proximate attaching sub segment, attachable to a work string or tool at one end thereof, and a distal nose segment, preferably having a wellbore treating section, coupled to the attaching sub segment at the other end thereof, the two segments being coupled in such manner that the nose segment may be semi-rigidly positioned so that its longitudinal axis coincides at least substantially with that of the attaching segment, or may be pivoted and semi-rigidly positioned at an acute angle with respect to the longitudinal axis of the attaching segment, the nose segment being of a length adapted for lateral wellbore incursion. The terminal section may optionally contain analysis or measurement components, although commonly these will be located in the main body of the tool. Indication that the axis of the terminal segment coincides at least substantially with the axis of the work-string or another sub segment merely indicates that, while perfect alignment is desirable and included, it is not required, and that, with consideration of the length of the terminal segment, deviation from coincidence does not occur to the extent that entry into a main wellbore is prevented. Accordingly, in each of the sub embodiments described herein, the sub may be lowered into the main wellbore "bent" to some degree if the main wellbore width is of such extent that the widest angular extension of the terminal segment does not bring the terminal segment into significant contact with the main wellbore.

In yet a further embodiment, a novel controllably bent sub for location, location and entry, and treatment and/or analysis of lateral wellbores is described, the sub being characterized by unique operational capabilities. The sub of the invention is adapted for maintaining semi-rigid or semi-flexible positioning of its terminal member or segment in the manner described, and in its preferred form, is provided with novel force relief means to prevent damage to its components by excess fluid pressure generated force or by accidental undue constraint of the "bent" arm or terminal member of the sub. The novel sub of the invention is further provided with means for alerting or signaling an operator when the terminal segment of the sub is "bent" more than a predetermined amount, i.e., the acute angle of the sub has increased or become greater. Other novel and unique aspects of the method, system, and apparatuses of the invention are set out more fully in the following detailed description.

DETAILED DESCRIPTION OF THE INVENTION

Figures 1, 2:
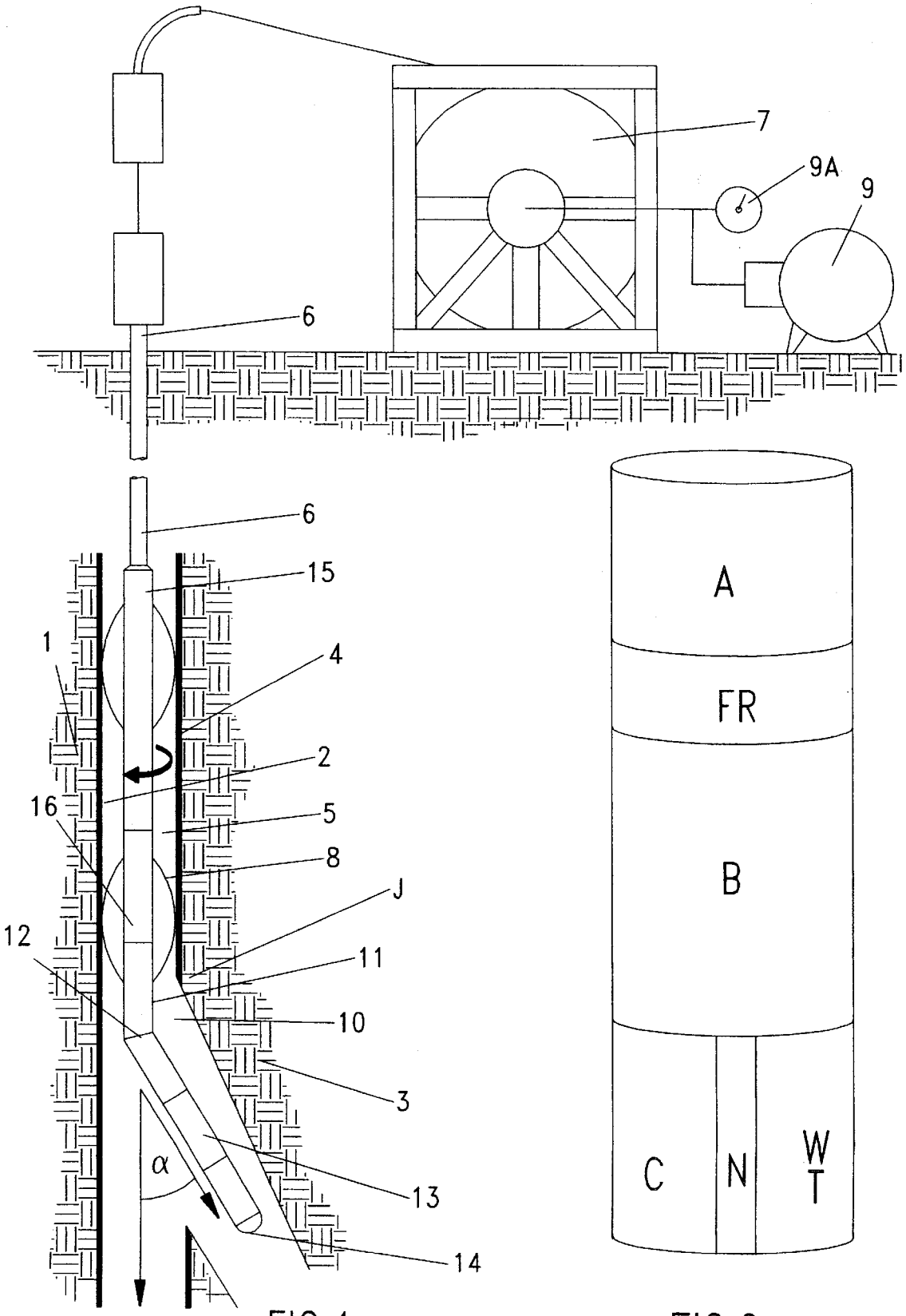
FIG. 2 is a schematic representation illustrating generally the components of a controllably bent sub according to the invention.

According to the method of the invention, a wellbore working tool is provided on a work string, the working tool comprising and terminating in a segmented work-locator sub comprising or having a terminal segment adapted to semi-rigidly or semi-flexibly position and/or to semi-rigidly or semi-flexibly deflect its terminal segment at an acute angle with respect to the longitudinal axis of the string, the terminal segment being of a length adapted for lateral wellbore incursion. The terminal segment may also possess some curvature, i.e., may be curved, as described more fully hereinafter. In the method of the invention, any controllably bent sub structure providing the required capabilities may be used, although, as mentioned, the specific subs described herein are preferred. Thus, subs designed with "knuckle joints" of different structure than the particular subs of the invention, or having restricted "ball joints" may be used if constrained to bend in the required manner and if provided, as mentioned, with appropriate force adjusting means, as well as the lateral incursion feature of the invention, and, most preferably, with well treatment and/or analysis features. Other means of accomplishing a "bend" include a pin joint, bourdon tube, or asymmetrically slotted member with internal pressurization means. Additionally, while the preferred subs of the invention emphasize flow of the work and treating fluids through the sub, e.g., through the terminal segment, other designs may be employed. For example, lateral ports in the sub may be used, with fluid ejection occurring in the remainder section of the sub or even in the main work tool body.

Accordingly, upon provision of a suitable working tool, in the case of a vertical main wellbore, the tool is then lowered in the main wellbore to a location proximate and below, or above, the lateral wellbore to be located or located and entered. The terminal segment of the sub of the tool will preferably be maintained, on lowering, at an angle coincident with or at least substantially coincident with the axis of the work string, minor deflection, as indicated, being possible, depending on the main wellbore diameter. In the case of a slanted or horizontal main wellbore, the tool is advanced into the main wellbore to a position proximate the lateral wellbore, either posterior to or anterior to the lateral wellbore. In either situation, the terminal segment of the sub is then positioned or deflected in the main wellbore at an acute or increased acute angle with respect to the longitudinal axis of the work string or other segment of the sub by applying a deflection force or moment to the terminal segment in excess of that required to thrust the distal or nose end of the terminal segment into contact with a constraining wall or side of the main wellbore. The effect of the application of excess deflection force or moment is that the terminal segment possesses potential for further increase or expansion of the acute angle of deflection should the constraint of the main wellbore wall or side be eliminated or dissipated. In this regard, for simplicity in description, the "wall" of a wellbore is understood to include not only the surface of the subterranean formation forming the wellbore, but may include casing, liner, cement, etc., present in the wellbore. At this point, operation of the sub to locate the lateral wellbore or "profiling" of the main wellbore may be commenced. Optionally, and preferably, however, the sub is then oriented in the main wellbore in the correct azimuthal direction by any known procedure and device. For example, the work string may include an indexing device or a continuously run motor providing 360 degree coverage which may be suitably employed by those skilled in the art to orient the sub. In the case of an indexing device, the index range is preferably on the order of 30 degrees.

To commence the profiling, in the case of a vertical main wellbore, and depending on the location of the sub, either below or above the lateral's junction with or entry to the main wellbore, the string is raised or lowered in the main wellbore. With a slanted or horizontal main wellbore, depending on the location of the sub, either posterior or anterior to the lateral's entrance, the string is retrieved or advanced. In both cases, the excess deflection moment on the terminal segment is maintained during movement or displacement of the string. In either case, the lateral wellbore may be located according to the invention in the following manner. As the sub is raised or lowered (or retrieved or advanced) in the main wellbore, the distal end or nose of the terminal segment of the sub, at an acute angle to the longitudinal axis of the string, continues in contact with the main wellbore wall or side. However, when the open lateral wellbore is reached, the constraining or confining force of the main wellbore wall or side is eliminated, and the tip force or excess potential energy in the semi-flexibly maintained terminal segment is released, expanding the acute angle made by the terminal segment with the longitudinal axis of the working tool or sub. If the terminal segment is of a length adapted for lateral wellbore incursion, the nose or end section thereof will be forced or urged into the open lateral wellbore, thereby "locating" the lateral. This expansion may be sensed by an operator at the surface by a variety of sensing mechanisms or means, and the terminal segment may then guided or advanced further into the lateral wellbore. Upon location and entry into the lateral wellbore, the terminal segment of the sub may be returned to and semi-rigidly fixed at a position or angle allowing advancement into the lateral. Normally, this will be a reduced acute angle or, preferably, an angle that is at least substantially coincident with that of the longitudinal axis of the work string or attaching sub segment. Treatment operations and/or analysis may then be commenced. The well treatment procedures which may be carried out are any of those commonly undertaken, such as acidizing, flushing, cementing, etc. In a particularly preferred embodiment, surface fluid pressure in the system is measured while raising the string, and the location of the lateral wellbore is signaled by change in pressure.

The invention is especially useful for re-entry of level 1 and level 2 multilateral wells, although it is not limited thereto. As employed herein, the expression "level 1" is used in the manner commonly understood in the art, as referring to well construction characterized by a "parent" or main wellbore with one or more lateral wellbores branching from the main wellbore. In level 1 wells, the wellbores are openhole and the junction is unsupported. The expression "level 2" is also used as commonly understood in the art, as referring to well construction characterized by a "parent" or main wellbore which is cased and cemented, with one or more openhole lateral wellbores branching from the main wellbore that may or may not include a drop-off liner. As employed herein, the expression "main wellbore" in not to be taken as referring simply to the principal or initial wellbore (whether vertical, slanted, or horizontal) in a multilateral wellbore system, but is to be understood to include a "secondary" wellbore, regardless of orientation, from which it is desired to enter another joining secondary wellbore.

In order to describe the invention more fully, reference is made to the accompanying drawing. In the interest of clarity, many features related to the manufacturing or maintenance of specific apparatus features of the invention, such as sectioning, beveling, or fileting, and common connection means, such as threading, which are well known or fully realizable by those skilled in the art, and which have no bearing on the essence of the invention, have not been described. Again, the very specific description of steps or elements herein are not to be taken as limiting, it being understood that equivalent steps or means are contemplated to be within the scope of the invention.

Accordingly, in FIG. 1 there is illustrated a typical location and entry of a lateral wellbore which has been carried out by the invention steps described previously. In particular, there is shown a segment or portion of a multilateral wellbore 1 having a vertical main well bore 2, with a lateral or slanted bore 3 connecting at a junction J. While a vertical main wellbore is illustrated, those skilled in the art will recognize that wellbore 2, as indicated, may be slanted or horizontal, and that, commonly, more than one lateral will be joining wellbore 1, although only one lateral is shown. In FIG. 1, vertical main wellbore 2 is provided with casing 4, but the connection of lateral bore 3 at junction J is an open hole connection.

Figure 1A:
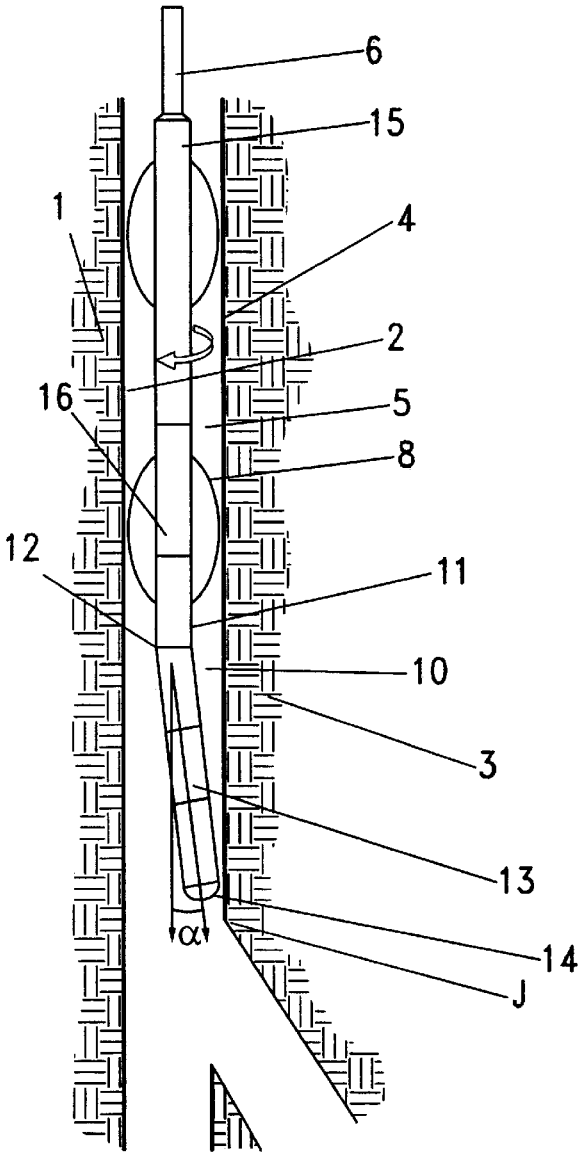
FIGS. 1A and 1B are schematic representations illustrating the lowering of the working tool to positions above and below a lateral wellbore in a manner according to the invention.
Figure 1B:
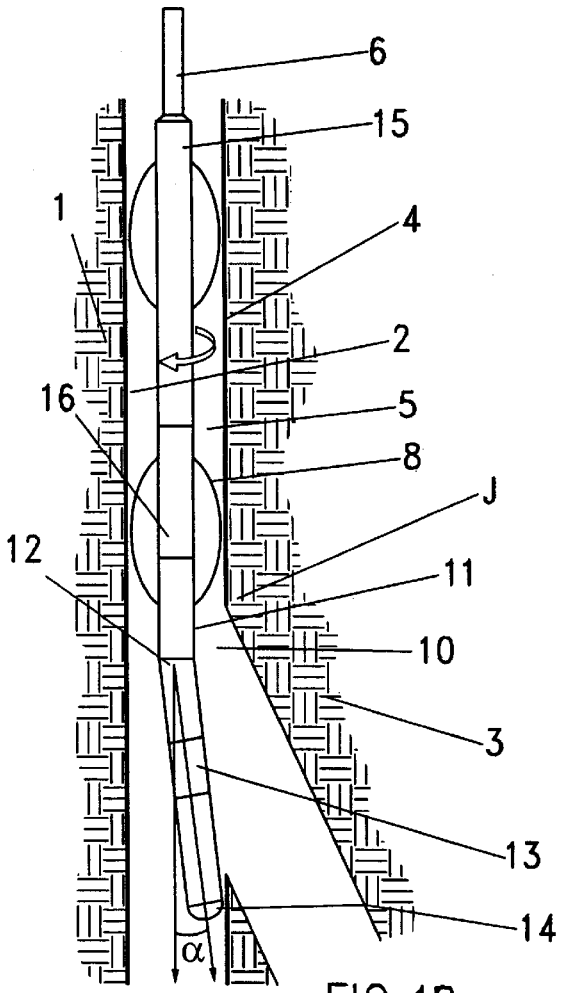

Designated generally as 5 is a working tool which embodies aspects of the invention. Working tool 5 is suspended from work string 6, the string in this case comprising coiled tubing, which has been supplied from coil 7 via a surface injector through the wellhead. The tool has been centered in the main wellbore with centralizers 8, and a knuckle joint (not illustrated) may be included in the assembly. The working or treating fluid is supplied through the coiled tubing by means of pump or pumps 9, from an appropriate supply source (not shown). While for profiling a common wellbore fluid, such as water or hydro-carbon fluid, may be utilized, for well treatment, such work fluids as acids, e.g., hydrochloric acid, flush liquids, spacers, and cements may be supplied. Pump means 9, along with pressure measurement means 9*a*, may also be used as a part of or a component of important means for determining the location of lateral wellbore 3, as discussed more fully hereinafter. Working tool 5 is comprised, importantly, of segmented work-locator sub 10, shown as providing insertion of a segment or portion thereof, or attachment thereto, into the lateral wellbore 3. As illustrated, sub 10 comprises an attaching and deflection section 11 and terminal or deflected segment 12. Terminal or deflected segment 12 includes extension or segment 13 as well as optionally tapered or rounded nose section 14, and segments 13 and 14 will preferably comprise structure for well treatment and/or analysis. Segment 12 is shown as being extended at an acute angle alpha with respect to the longitudinal axis of the working tool or of segment 11, and is sized in a length sufficient for lateral wellbore incursion. In the illustration of FIG. 1, the angle alpha is the maximum deflection of terminal segment 12, the angle having increased from its previous arc when the terminal segment 12 was constrained by the main wellbore 2, as illustrated in FIGS. 1A and 1B wherein the working tool has been lowered to a point at which the terminal segment 12 is located, respectively, above or below the lateral wellbore. While the maximum value of the angle alpha may be varied depending on the main wellbore size and on the size of terminal segment 12, suitable deflection angles for practicing the method of the invention and use of the sub of the invention, assuming the terminal section of the sub to be "straight", will range from about 3 or 4 degrees to about 30 degrees with a range of from about 4 degrees to about 15 degrees being preferred. In this regard, the shape of terminal segment 12 may be varied or irregular to some extent, and, as mentioned, may have some curvature or angularity (not illustrated), so long as the angular and sizing parameters thereof are consonant with the requirements described herein. In such case, the acute angle of deflection may be considered to be defined by the intersection of the longitudinal axis of the string or other segment of the sub and a line from the beginning of the curve, where the curve is tangent to the longitudinal axis of the string or other segment of the sub, through the end or tip of the terminal segment of the sub.

In the manner described previously, the lateral 3 has been located by utilization of the excess deflection force approach of the invention, and in this case, by proper orientation of the sub. Segment 15 of tool 6 will include the appropriate orienting equipment, such as indexing means, or an orienting motor, and may include other analyzing and/or treating components as are common in working tools, as well as telemetry components, and these may also be present in the segments designated 16 and 13.

FIG. 2 is a schematic illustration of the arrangement of the respective operating sections of the novel controllably bent sub of the invention, shown in an orientation suitable for entry into a main wellbore. In the assemblies of the sub shown in the additional views of the drawing hereinafter, which, because of length and complexity are provided in sections, it will be understood that the arrangement of the sub follows the scheme of FIG. 2. Accordingly, in FIG. 2, letter A designates a hydraulic pressure transmission section, which converts fluid pressure to mechanical force, and which may include an optional and preferred further load limiting and back force relieving section FR; letter B denotes a segment of section which provides conversion of mechanical force transmitted thereto to deflection of a locator or caliper segment or arm, and may include structure responsive to a deflection of the locator segment for signaling such deflection; and letter C denotes a locator or caliper segment or structure N providing means for lateral wellbore location or entry as well as structure for well treatment (WT).

Figure 3A:
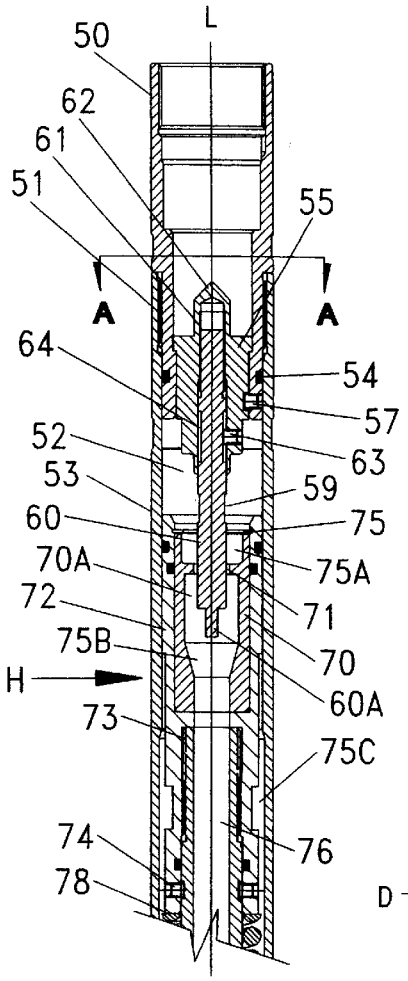
FIGS. 3*a*, 3*b*, and 3*c* are cross-sectional views of a controllably bent sub of the invention in the plane of the sub's bend illustrating sub orientation adapted for lowering or insertion of the sub into a main wellbore.
Figure 3B:
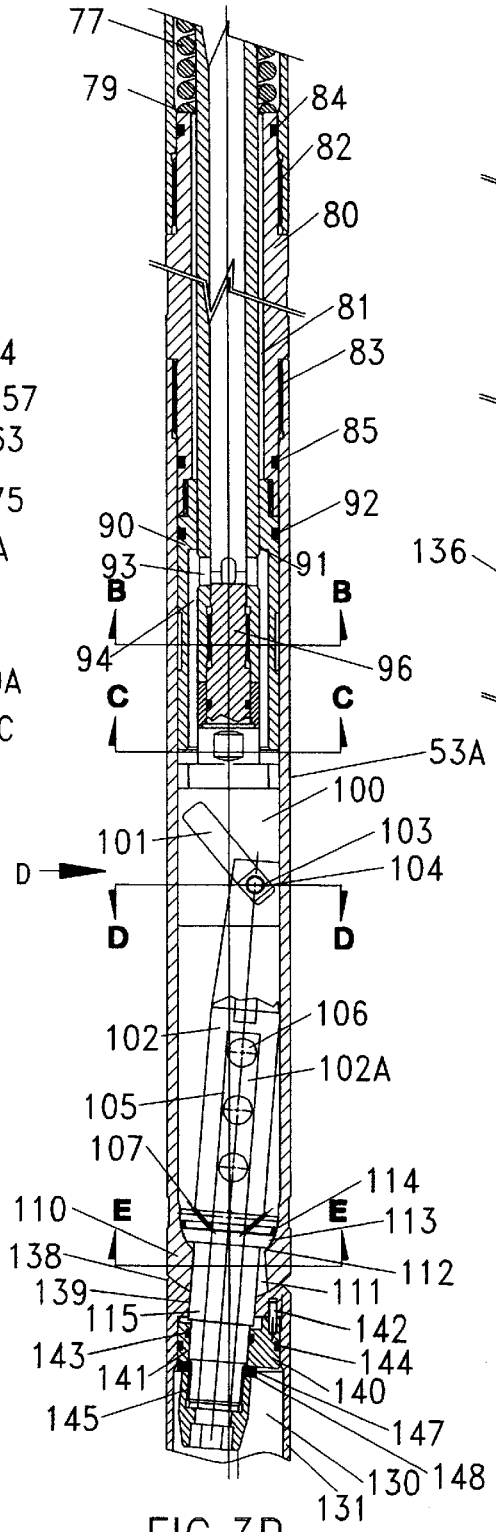
Figure 3C:
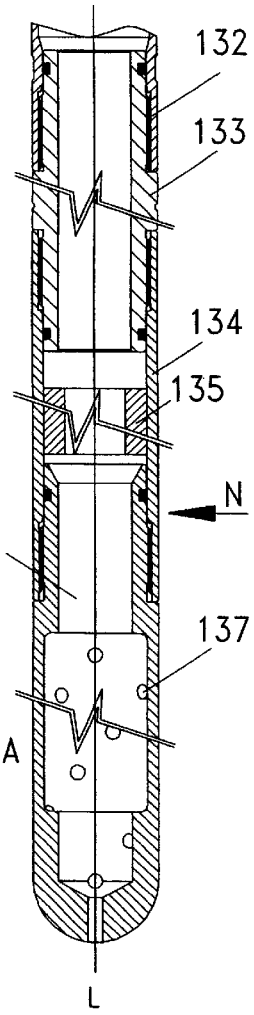

FIGS. 3*a*, 3*b*, 3*c*, 4*a*, 4*b*, and 4*c* illustrate the assembly of a sub which may be bent in controlled manner to carry out the lateral wellbore location, and location and entry aspects of the invention, as well as being adapted to perform appropriate well treatment and/or analysis once the lateral wellbore entry has been achieved. As shown in FIGS. 3*a*, 3*b*, and 3*c*, there is provided a housing section or pipe 50 which comprises means, not illustrated, such as a box end, for attaching one end thereof to a pin for suspending on a work string. Commonly, such a string may include, anterior to the connection with 50, and not illustrated, check valves, a disconnect (in the event the tool gets stuck), and a circulation sub. At the opposite end, housing section 50 is connected, suitably with threads or other suitable means 51, and communicates with chamber 52 in housing member 53, to form a first or principal housing for containing the components of A and B of FIG. 2. The housing 53 is adapted for wellbore insertion, being sized in light of the diameter of the wellbore to be entered, and will preferably be shaped externally, as shown, in a generally cylindrical or tubular shape, although this is not required. A seal or seals 54 are provided for a fluid tight arrangement. Alternatively, a proper seal may also be achieved by other means, such as a metal to metal seal (not shown), or in some cases, eliminated if not required by the application.

Figure 5:
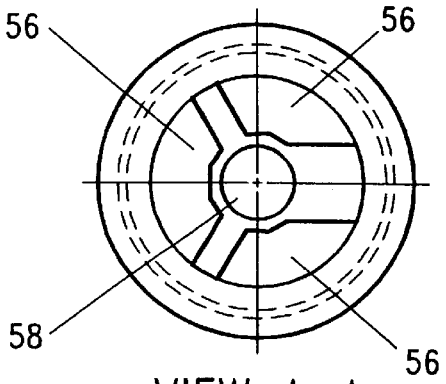
FIG. 5 is a sectional view along line A—A of FIG. 3*a*.

Mounted in housing section 50 proximate its entry into chamber 52 is an optional flow directing and limiting orifice rod component. In particular, there is shown a flow directing and mounting member 55 which is shaped to provide flow paths or ports 56 for fluid transmission, a cross-section thereof being shown in FIG. 5. The position of member 55 is determined by shoulder, as shown, with a set screw 57 or by other suitable means employed for retention. Member 55 is also provided with a bore 58 in which is mounted an orifice reduction means or rod 59. Rod or member 59 comprises pin section 60, and is suitably mounted for movement in extension 61 of bore 58 formed by retainer section 62 of member 55. Rod 59 is threaded in member 55, with set screw 63 in slot 64, or other suitable means, provided for stability, and the longitudinal axis of rod 59 preferably coincides with the longitudinal axis L of the housing 53.

In the configuration illustrated in FIGS. 3*a*, 3*b*, 3*c*, pin 60 extends in chamber 52 into an orifice insert 70, which may comprise more than one element, and which defines a orifice chamber 70*a*, having a defined orifice 71. Extension of the tip 60*a* of pin 60 into orifice area 71 causes a larger flow area and thus a lower pressure drop when the area 71 is in its lowermost position. The insert 70 is mounted in a body or member 72. Body 72 extends in housing 53, being slidably mounted therein for longitudinal displacement, and is fixed to a mandrel 73 by threading and by screws 74 or other suitable means. Retainer ring 75 holds orifice insert 70 in place in member 72. As will be evident to those skilled in the art, orifice insert 70 and body 72 combine to form a piston (designated generally as H) which is employed for longitudinal displacement of mandrel 73 in housing 53, and which is thus adapted to transmit fluid force applied. In particular, piston H includes the hollow chamber sections 75*a* and 70*a* and throat 71. Chambers 75*a* and 70*a* connect through throat or bore 71, section 70*a* communicating through the aperture or inlet 75*b* with a bore 76 in mandrel 73. Body 72 is preferably provided with a hex cross-section at 75*c*, the hex section allowing torquing of member 72 on to mandrel 73. Accordingly, if the mandrel 73 is not constrained, piston H and mandrel 73 may be displaced along the longitudinal axis of housing 53 by suitable application of fluid pressure acting on the piston H.

However, resisting the movement of piston H and mandrel 73 is spring 77, which surrounds mandrel 73 over a portion of its length. Spring 77 abuts the end 78 of piston H at one end and at its other end abuts shoulder 79 of crossover sleeve 80 (FIG. 3*b*). Various constructions, including making 79 an integral abutment in 53, may be employed, but as shown, shoulder 79 is formed by a sleeve 80, the sleeve 80 having a bore 81 through which mandrel 73 may translate. Accordingly, spring 77 provides a resistance to the movement of piston H and mandrel 73, to the end that diminished force is translated from the piston H to further components of the tool. While selection of a spring of appropriate characteristics, e.g., size and spring preload, will depend on a variety of factors, such as mandrel size and the desired resistance, etc., and is well within the ambit of those skilled in the art, a suitable spring preload, for example, might range from 150 to 600 lbs for a 2⅛" outside diameter tool. The spring preload is calculated as the free length minus the assembled length of the spring, i.e., the deflection, times the spring rate. The spring 77 preload determines the pressure drop required to overcome the spring preload force and causes the terminal segment to deflect. The net orifice flow area 60*a*,71 may be varied in order to allow the sub to deflect only at a flow rate higher than a predetermined threshold.

Figure 6:
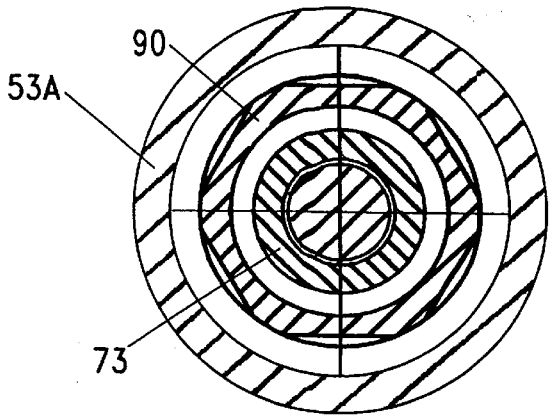
FIG. 6 is a sectional view along line B—B of FIG. 3*b*.
Figure 7:
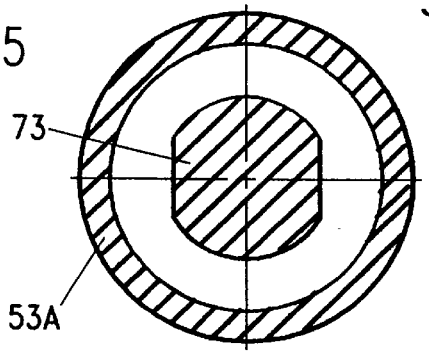
FIG. 7 is a sectional view along line C—C of FIG. 3*b*.
Figure 9:
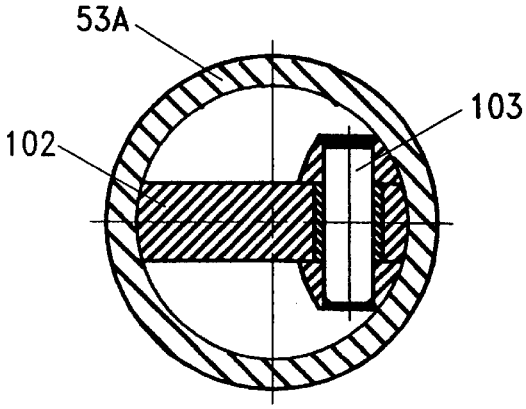
FIG. 9 is a sectional view along line D—D of FIG. 3*b*.
Figure 8A:
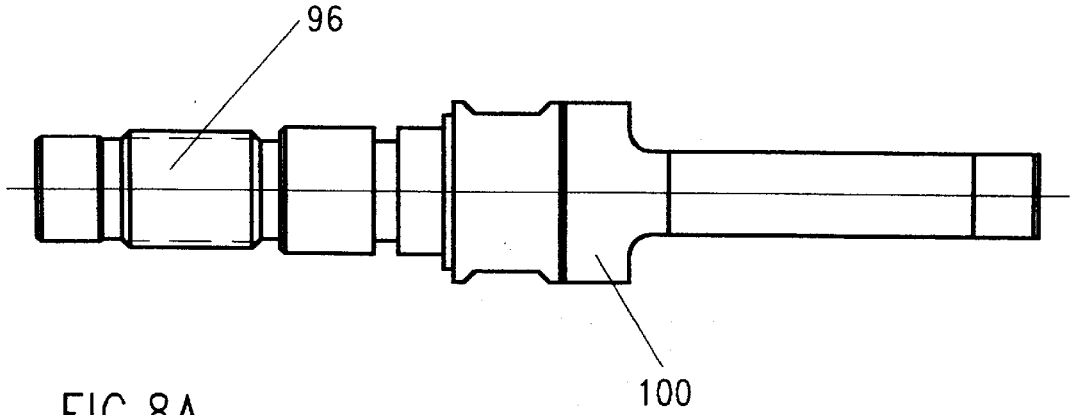
FIGS. 8*a* and 8*b* are sectional views of a plug and cam structure employed in a sub of the invention along the longitudinal axis L of the sub.
Figure 8B:
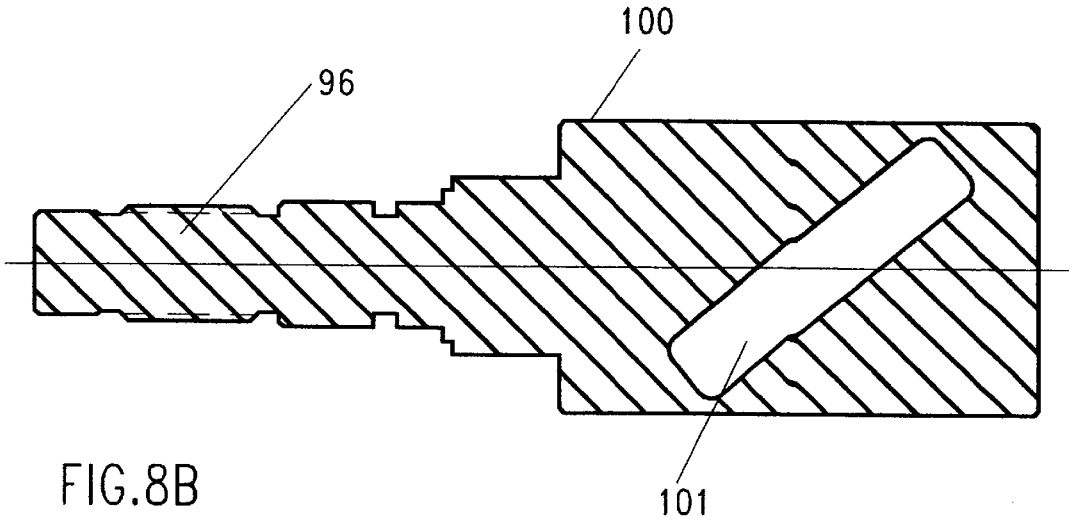

In this embodiment, the mandrel 73 translates the hydraulic force acting on piston H to a deflection section D where that hydraulic force is converted and utilized in section 53*a* of housing 53 by appropriate structure to deflect a locator-work member at an acute angle in a plane passing through the longitudinal axis L of the tool. More particularly, mandrel 73 passes through the connecting sleeve 80 which is joined to or forms part of housing 53. Sleeve 80 is provided at each end with suitable connecting means, such as threads 82 at one end and threads 83 at the other. Seals 84 and 85 are provided as shown. A further sleeve member 90 is mounted in the housing as shown, mandrel 73 passing through member 90 in the bore 91 thereof. Sleeve 90 is provided with seal 92. Mandrel 73 is provided with an outlet or outlets, such as ports 93 for egress of fluid from the interior or bore 76 of the mandrel. As will be evident, sleeve 90 is shaped to allow fluid from ports 93 to exit mandrel 73 and into the bore or space 94. The bore 76 of the mandrel is plugged or closed at a location proximate the ports 93 with plug section 96, illustrated in FIG. 6, of cam member 100. Cam member 100, including plug 96, is shown in additional detail in FIGS. 7 and 8*a* and 8*b*. The plug section or member 96 closes the internal fluid passage 76 of mandrel 73. Plug member 96 is threaded into mandrel 73. The plug member 96 is preferably connected integrally to the cam member or section 100, the latter having a slot guide 101, although the sections may be joined by other means of assembly. Alternatively, cam member 100 may be integral with mandrel 73 (not shown). Cam member 100 is mounted for sliding displacement in the bore of section 53A, receiving, as indicated, the longitudinal thrust from mandrel 73. The slot guide 101 is preferably substantially rectangular and converts the longitudinal movement of mandrel 73 and cam member 100. In particular, there is provided a pivot shaft 102 with cam pin 103 mounted securely on an end portion of the pivot shaft 102 for movement in cam slot guide 101. As further illustrated in FIG. 9, a square slider 104 is mounted on the cam pin 103 for sliding movement in the cam slot 101. Slider 104 increases the bearing area, although the can pin may be run directly in cam slot 101. For simplicity, the expression "pin member", as employed herein, is taken to include either of these arrangements, as well as equivalent means. A curved cam is also possible with a round cam follower. The connecting end of pivot shaft 102 may be of generally solid construction, but the segment 102*a* of pivot shaft 102 contains a bore or internal fluid passage 105 which communicates with the bore or internal space of housing section 53A through an outlet or outlets such as ports 106. In addition, anti-debris turbulence creating ports 107 provide flow into bore 105. Accordingly, fluid may flow through ports 93, through the bore or space 94 of housing 53, into the ports 106 and 107, and through bore 105, as described more fully hereinafter.

Housing section 53*a* terminates in an apertured enclosure 110. In the illustration, closure 110 comprises a specially designed arcuately shaped, apertured structure, which may be integral with housing 53*a* (preferably), or which may also be provided as a cap (not shown), suitably attached. The exterior of arcuate closure 110 provides an apertured segment of a sphere or "ball" which cooperates with a closure 138, as discussed more fully hereinafter. As shown, closure 110 is provided with a longitudinally outwardly expanding aperture 111 whose center axis is preferably located at least substantially coincident with the longitudinal axis of housing 53*a*, although this is not required. The interior wall of closure 110 is also arcuately shaped (not necessarily the same arc as that of the exterior wall), as indicated by numeral 112.

Figure 10:
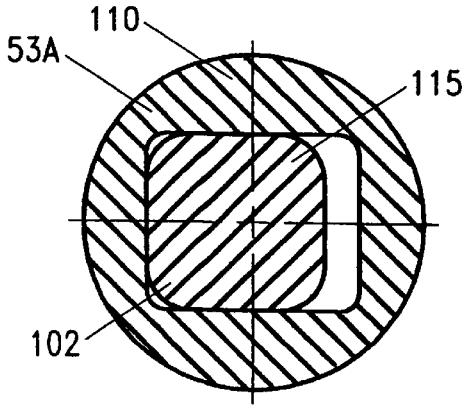
FIG. 10 is a sectional view along line E—E of FIG. 3*b*.

Pivot shaft 102 is provided with a circumferentially disposed mounting shoulder 113 which defines a segment of a sphere which is sized and shaped for cooperation with the interior arcuate surface 112 of closure 110. A seal 114 is provided in shoulder 113 for preventing passage of fluid through aperture 111. The segment or extension arm 115 of pivot shaft 102 extends from shoulder 113 through and beyond aperture 111. Member 115 and aperture 111 are sized appropriately for substantial clearance between them to variable acute angle generation by member 115 through the aperture 111 as illustrated in FIG. 10.

Extension arm 115 of pivot shaft 102 is joined with the sub segment designated generally as N by appropriate means, as exemplified hereinafter. The terminal segment N is adapted for wellbore insertion and is multi-functional, in that it comprises the culminating component for lateral wellbore location and further may be adapted for well treatment and/or analysis. For example, in addition to design features related to its caliper or locator function, the segment N may include, and preferably will, means, such as ports, for ejection or egress of treating fluids, as well as a subsection or subsections for measurements or analysis.

Accordingly, as shown, the end of extension arm 115 extends into segment N, terminating in an anchoring closure sub-section 130 thereof. The sub-section 130 preferably comprises a generally cylindrical housing 131, although this shape is not required, which is suitably attached to, as by threads 132, and forms a portion or section of, housing 133. Housing 133 may include, or be appropriately coupled at a location distal from housing 131, with a sub-section 134 which may contain, for example, an instrument and telemetry package 135. Subsections 130 and 134 are adapted to provide fluid flow therethrough from the bore of extension arm 115, to the end that fluid may be transmitted to a nose sub-section 136, which joins and communicates with sub-section 134, and to egress or ejection through outlets or ports 137.

In the embodiment shown, the portion of housing 131 enclosing the end of arm 115 and proximate the segment 53*a* terminates in an apertured recessed anchoring closure surface 138, with the aperture 139 sized and adapted to receive the terminal section of extension arm 115 with a relatively close tolerance and in a manner which prevents relative rotation. For anchoring extension arm 115 in housing 131, there is first provided a dual taper bushing 140 with angularly offset bore 141, the bushing 140 being secured from rotation by a dowell pin 142 and being provided with seals 143 and 144. A threaded terminus 145 of extension arm 115 is secured to segment N by a hollow nut 146 which does not interfere with fluid flow from the bore of extension arm 115. Compression means 147, such as Belleville washers or a spring, are provided, as well as shim or backup washer or washers 148. Accordingly, closure 110, shoulder segment 113, pivot shaft 102, extension arm 115, recessed closure 138, and related anchoring components thus provide an effective "knuckle" joint arrangement which, in cooperation with the cam 100, cam slot 101, and pin 103, as will be evident, provide displacement in a plane passing perpendicular to the central axis of pin 103. The structure described thus provides limited flexible deflection of the terminal segment. That is, the cam slotpivot shaft arrangement permits travel of the slider and pin (and thus the pivot shaft movement in the housing) to the end that, if the terminal segment is constrained, or if the constraint is removed, the terminal segment has a limited degree or freedom of movement. Preferably, a line bisecting and connecting the short sides of the rectangular slot 101, if coplanar with the longitudinal axis of the mandrel 73, would make an acute angle with the longitudinal axis of mandrel 73 of from 25 to 60, most preferably 35 to 45 degrees.

Operation of the embodiment illustrated in FIGS. 3*a*, 3*b*, 3*c* and 4*a*, 4*b*, 4*c* is described, as follows. The sub is mounted by attachment of the pipe 50 or housing 53 to the end, for example, of a work string, such as a coiled tubing work string 6 providing an assembly comprising an indexing/orienting tool or motor, and the string and assembly with sub is lowered into or positioned in a main wellbore. In preparation, the length of section N of the tool, including the nose section 136, is selected based on the diameter of the main wellbore, as described previously. When there is little or no fluid flow through the tool, the force of spring 77 keeps the mandrel 73 at its resting or inactive position, as shown in FIGS. 3*a*, 3*b*. This corresponds to the straight position of segment N in FIG. 3*c*, i.e., there is little or no pivot or deflection of segment N. This orientation of segment N allows introduction of the tool into the main wellbore to the desired depth while flowing at a low rate through the tool. In the preferred operational configuration, working or treating fluid from a workstring will flow through section 50, passing through openings 56 into chamber 52, through the internal fluid passage formed by 75*a*, 71, and 75*b*, and into the bore or internal fluid passage 76 of mandrel 73. From the bore of mandrel 73, fluid will continue through outlet or outlets 93 into the internal or inner space 94 of housing 53, past the cam member 100, entering the bore or internal fluid passage 105 of pivot shaft section 102*a* via ports 106, through the bore of nut 146 and into the housing 131, sub section 136, and out ports 137.

Figure 4A:
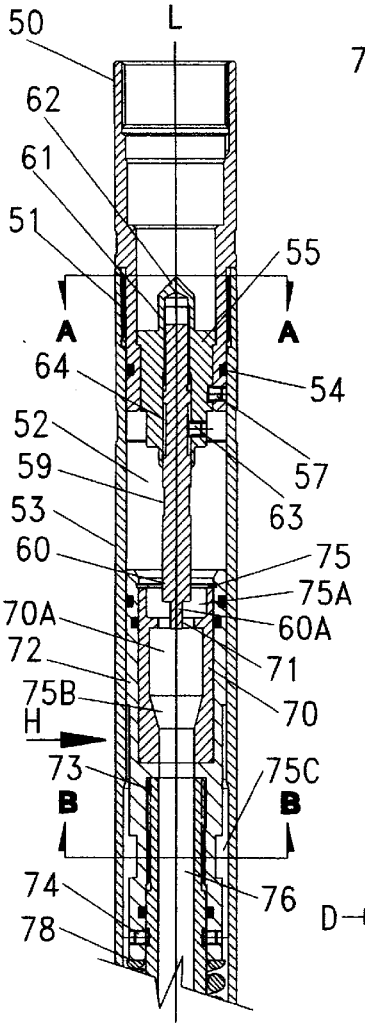
FIGS. 4*a*, 4*b*, and 4*c* are cross-sectional views of a controllably bent sub of the invention in the plane of the sub's bend illustrating sub orientation adapted for location of and entry of the sub into a lateral wellbore.
Figure 4B:
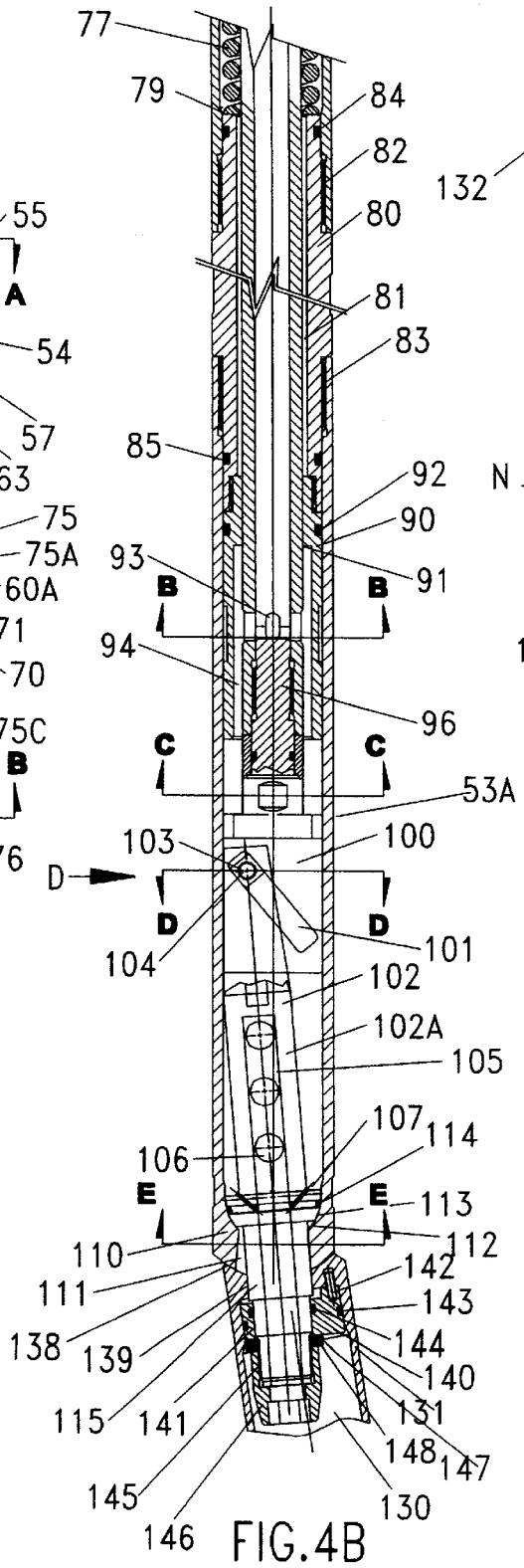

Upon reaching the desired depth or a locus proximate the lateral to be located, for example, at a site below or past the lateral, preferably the sub is rotated by suitable means in the string, such as the indexing means mentioned, or by a continuous rotation motor. Upon reaching the desired orientation, fluid flow rate through the tool is increased. As the flow rate is increased, a pressure drop occurs across the annular gap between the orifice rod 60 and the orifice 71. This pressure drop generates a force acting on the piston, the force acting in a direction away from the fixed orifice rod mount 55. In the case of a vertical main wellbore, this will, of course, be "downward"; in a slanted or horizontal main wellbore, directed "down hole". When the flow rate exceeds a threshold flow rate, the acting force due to pressure drop across the orifice rod/orifice exceeds the force of spring 77, causing the piston H to move longitudinally, as illustrated in FIG. 4*a*, and, since the piston H and mandrel 73 are joined, as described, the mandrel 73 moves correspondingly (FIGS. 4*a*, 4*b*). The pressure drop also may be sensed by gages at the surface, providing a signal to the operator.

Figure 4C:
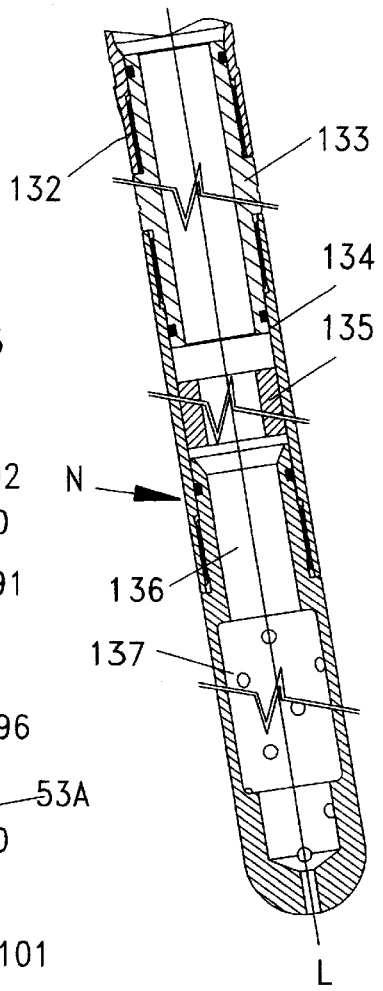

The longitudinal movement or displacement of the mandrel 73 correspondingly moves the cam 100 and its cam slot 101, forcing the slider 104 and the cam pin 103 to move angularly to the longitudinal axis of the sub (FIG. 4*b*). This movement of the slider/cam pin causes the pivot shaft 102 to move laterally in the housing. Because the "ball" surface 113 is longitudinally fixed in place by arcuate recess 112 and the tensioned anchoring of extension arm 115 in segment N, the pivot shaft 102 is translated or deflected in a plane perpendicular to the longitudinal axis of pin 103. The deflection of pivot shaft 102 forces a corresponding deflection of the terminal segment 115 in the opposite direction, the fixed anchoring of terminal segment 115 in segment N allowing the deflection of segment N including section 136 to the side or wall of a main wellbore (FIGS. 4*b* and 4*c*). If the flow rate of the driving fluid is, and is maintained sufficiently great (and thus the pressure drop acting on piston H), the tip force or energy acquired by segment N is greater than that required to reach the main wellbore side or wall. In a given case, for example, this profiling flow rate might be maintained at 2 barrels per minute. Because the wellbore wall constrains the section 136, this excess energy or tip force may be utilized for location of the lateral wellbore. In this circumstance, the pivot shaft 102 does not reach contact with interior surface of housing 53*a* or rectangular opening 111.

The tool is then raised or moved uphole (in the direction of the surface) in the main wellbore while maintaining fluid flow rate, thus maintaining excess tip force in the terminal segment. When the opening of the lateral wellbore is reached, the constraint of the main wellbore is eliminated, and because the length of the section N is of a length adapted for lateral wellbore incursion, excess energy maintained or present in the segment urges or forces the tip 136 into the lateral wellbore, thus locating and providing entry into the lateral. In this case, the release of segment N may cause pivot arm 102 to contact with the inner surface of housing 53*a*.

Figure 11:
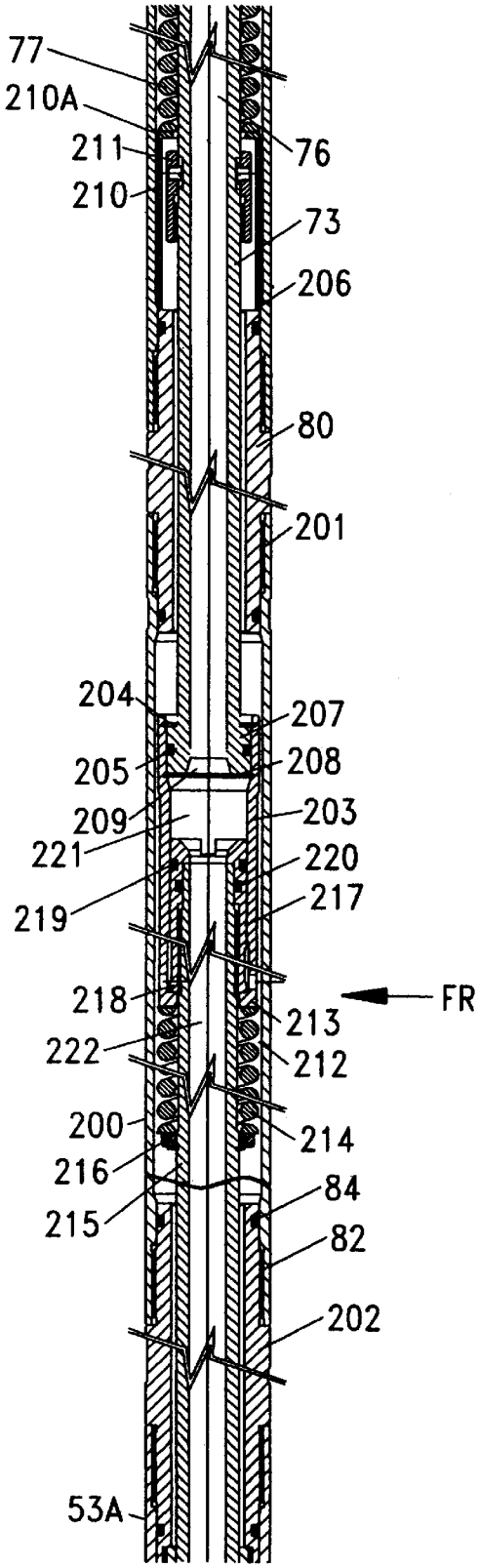
FIG. 11 is a cross-sectional view of the preferred unique force limiting transmission means of the invention in a straight sub orientation.
Figure 12:
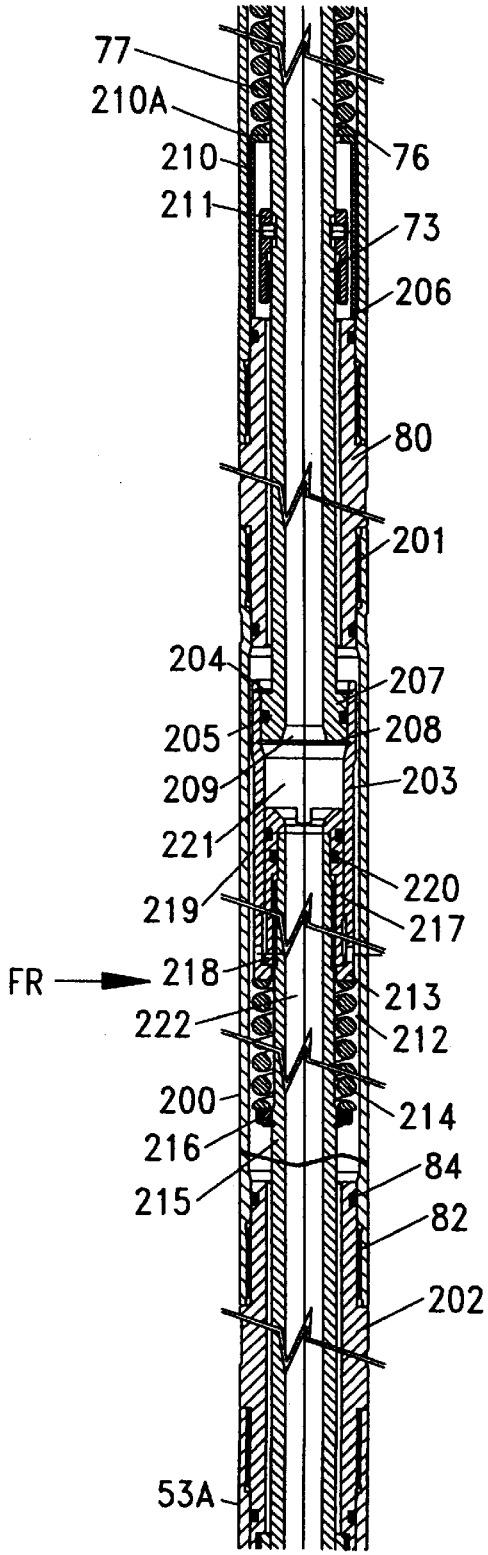
FIG. 12 is a cross-sectional view of the preferred unique force limiting transmission means of the invention in a bent sub orientation.
Figure 13A:
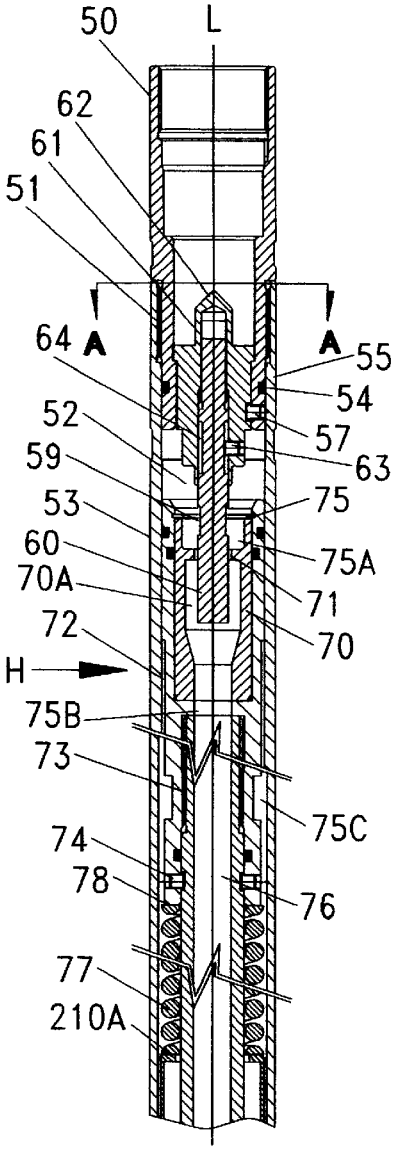
FIGS. 13*a*, 13*b*, 13*c*, and 13*d* are cross-sectional views of a controllably bent sub of the invention in the plane of the sub's bend containing the force limiting transmission means of the invention.
Figure 13B:
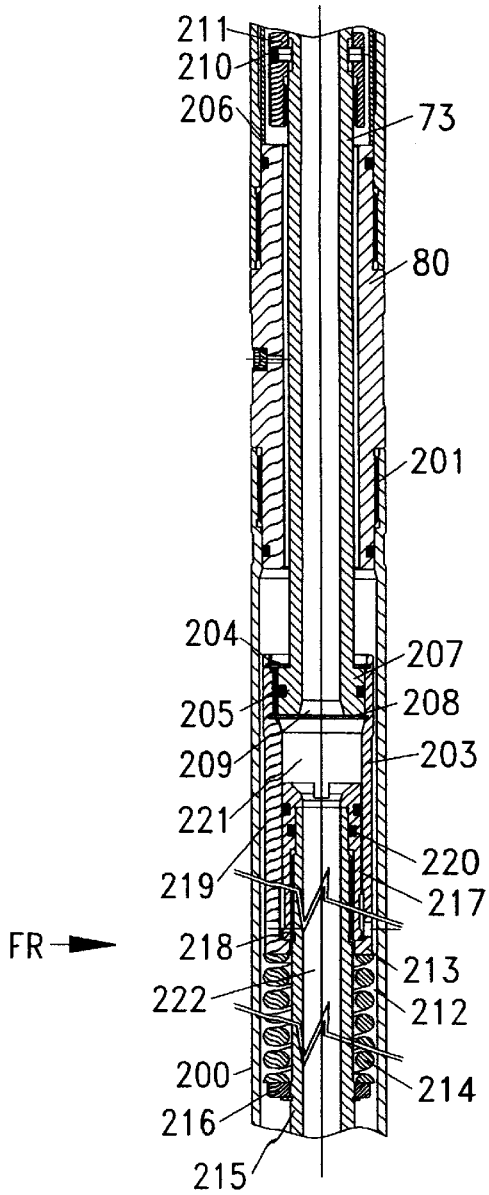
Figure 13C:
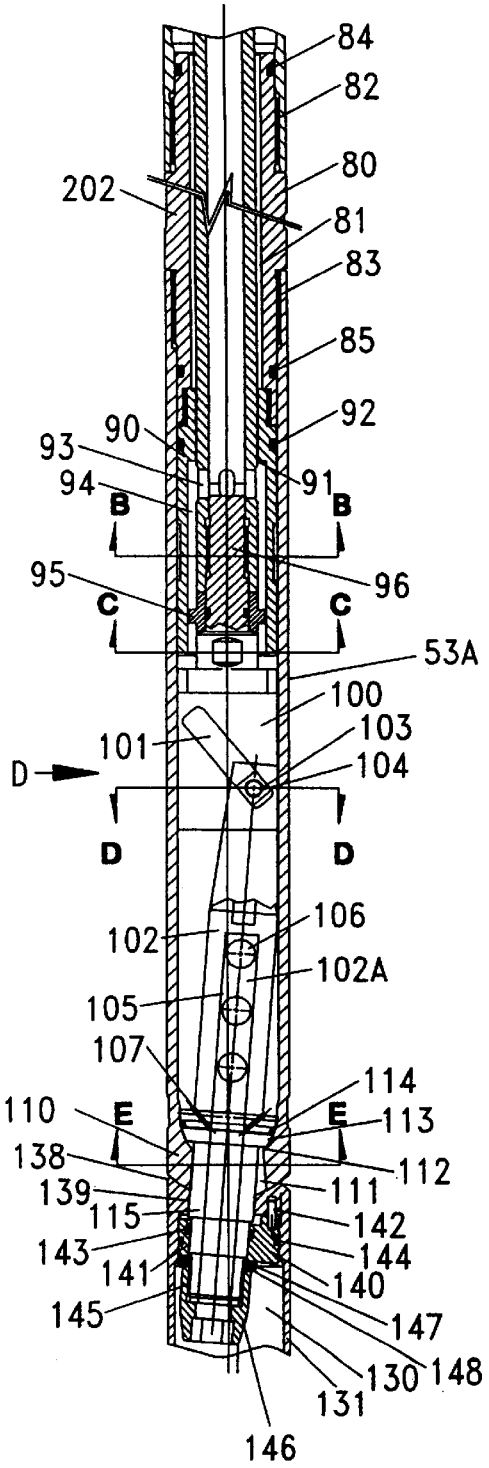
Figure 13D:
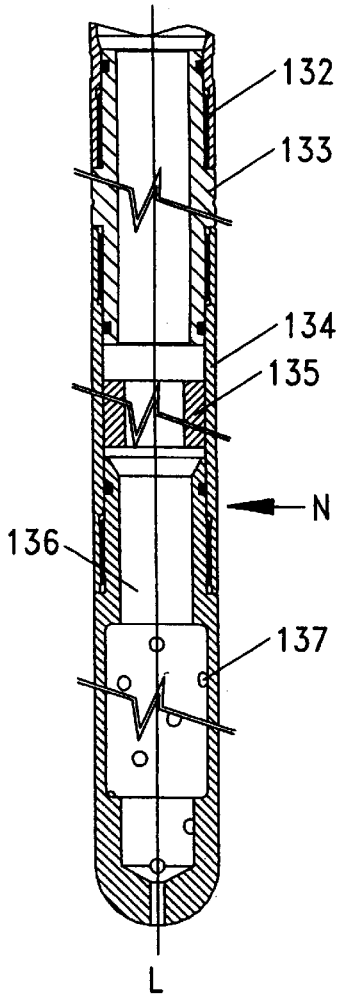

FIGS. 11 and 12 illustrate a preferred force relief mechanism which may be incorporated into a sub according to the invention. In particular, the relief structure of FIGS. 11 and 12 may be incorporated in the device described in FIGS. 3*a*, 3*b*, 3*c* and 4*a*, 4*b*, 4*c*, in the manner illustrated in FIGS. 13*a*, 13*b*, 13*c*, 13*d* and FIGS. 14*a*, 14*b*, 14*c*, 14*d*. Additionally, the embodiments of FIGS. 13*a*, 13*b*, 13*c*, 13*d* and FIGS. 14*a*, 14*b*, 14*c*, 14*d* employ a unique pressure change signaling structure, to the end that the tool operator may be alerted when the lateral wellbore has been reached. In FIGS. 11 through 15*d*, like numbers indicate like features.

Accordingly, there is shown in FIG. 11 a force relief section, designated generally as FR, which comprises a housing 200 adapted for wellbore insertion, preferably being cylindrical or tubular, which may, as mentioned, and, as illustrated hereinafter, form or comprise part of first housing 53. Housing 200 is joined by suitable connection to and communicates with sleeve 80, such as by threads or equivalent means 201. At the opposite end of housing 200, housing 200 is connected to and communicates with sleeve 202, which may be identical to or analogous to sleeve 80. However, mandrel 73, rather than terminating in section D, terminates in section FR in a hollow sleeve 203. Sleeve 203 is fixed by suitable means, such as retaining ring 204 and seal 205, to the end of mandrel 73, which further comprises an expanded shoulder section 207. A retaining ring 208 is provided, with the end 209 of the mandrel 73 being tapered to the size of bore 76. Additionally, rather than abutting shoulder 79 of sleeve 80, as illustrated previously in FIG. 3*b*, the spring 77 is provided a stop sleeve 210 with shoulder 210*a*, while the mandrel 73 has a range limiting stop 211 restricted by the shoulder 206 of sleeve 83.

Sleeve 203 extends into the hollow section 212 of sleeve 200, sleeve 203 being sized and adapted for longitudinal displacement or movement inside the bore 212 of sleeve 200. At the end of sleeve 203 there is provided a shoulder 213, which is in contact with and receives the force of spring 214. The load protection spring 214 surrounds a second hollow mandrel 215 over a portion of its length and abuts shoulder or stop 216 on mandrel 215. The selection of a spring having the required characteristics or spring 214 will depend on a variety of factors, such as the desired resistance, etc., as discussed previously, and is within the ability of those skilled in the art. Shoulder 216 may be integral with mandrel 215, or may be provided separately, as shown.

The second mandrel 215 is provided with a coupler sleeve 217 whose outer diameter is sized for sliding movement or displacement in sleeve 203. Sleeve 217 is mounted on mandrel 215 in any suitable fashion, such as by threads, and has a boss 218 which limits longitudinal displacement of the mandrel 215 by cooperation with the shoulder 213 of sleeve 203. Sleeve 217 is further provided with O-ring seals 219 and 220. Accordingly, there is provided a chamber 221, bounded by the end of first mandrel 73, the proximate end of second mandrel 215, and the sleeve 203, which will vary in length depending on the displacement of mandrel 215, the chamber 221 providing a sealed fluid flow path from the bore of mandrel 73 through the bore or internal fluid passage 222 of mandrel 215.

In the preferred embodiment of the invention, the above-described force relieving device is incorporated, as indicated in FIG. 2, into the force conversion segment A, thus providing a controllably bent sub with unique force relief and deflection characteristics. Reference is made, in addition to FIGS. 11 and 12, to FIGS. 13*a*, 13*b*, 13*c*, 13*d* and 14*a*, 14*b*, 14*c*, 14*d* which illustrate the preferred sub operational configurations. The preferred configurations additionally comprise a novel pressure reducing and different signaling element, not used in the sub of FIG. 4*a*, 4*b*, 4*c*, and whose manner of operation is described in connection with the description relating to FIGS. 14*a*, 14*b*, 14*c*, 14*d*. Accordingly, in FIG. 13*b*, sleeve 80, as described previously, rather than joining housing 53*a*, connects with and communicates with the housing 200. Housing 53*a* is, instead, connected to and communicates with sleeve 202. The mandrel 73, rather than terminating in section D, terminates in a section designated generally as FR and is in fluid communication with chamber 221.

In the preferred configuration, two modes of operation are permitted. Depending on fluid flow rate through the sub, both first mandrel 73 and second mandrel 215 may move as a single entity, or the motion of the two mandrels may be decoupled from each other. If mandrel 73 and mandrel 215 move as a unit, mandrel 215 simply functions as mandrel 73 in the manner described in relation to FIG. 4*a*, 4*b*, 4*c*, moving the cam slot 101 and thereby causing the slider 104 and the cam pin 103 to move angularly to the longitudinal axis of the housing 53. Deflection of the segment N occurs in the manner described previously with respect to FIGS. 4*a*, 4*b*, 4*c*.

On the other hand, if mandrel 215 is decoupled from mandrel 73, as described hereinafter, the result is significant limiting of the force applied to the cam of the cam-deflection mechanism. This decoupling permits deflection of the segment N, while limiting the force applied and preventing overload on the cam member 100. Conversely, decoupling insures that, if significant constraining force is encountered by the terminal segment N, the cam mechanism is protected. For example, in the circumstance where the operator has located the lateral (the effective diameter measured is larger than that of the main wellbore), but has continued movement of the sub and has pulled the nose section 136 from the lateral upwardly or anteriorly in the bent position, the constraining force of the main wellbore on the cam is relieved by the decoupling. In such case, the tip 136 will be forced back into the main wellbore while allowing the angle of deflection $\alpha$ to be reduced.

Accordingly, with reference to FIGS. 13*a*, 13*b*, 13*c*, 13*d*, if there is no significant fluid flow through the sub, the terminal segment N is maintained in alignment with the other sections of the sub, i.e., generally aligned with the longitudinal axis of the housing 53. This alignment is accomplished by the spring force from 77 acting on the coupled first and second mandrels 73 and 215, which pull the cam member 100 toward the housing section 50, causing the pivot shaft 102 to be positioned in the manner shown in 13*c*. This position may advantageously be employed in main wellbore entry or advancement in or retrieval from a wellbore.

Figure 14A:
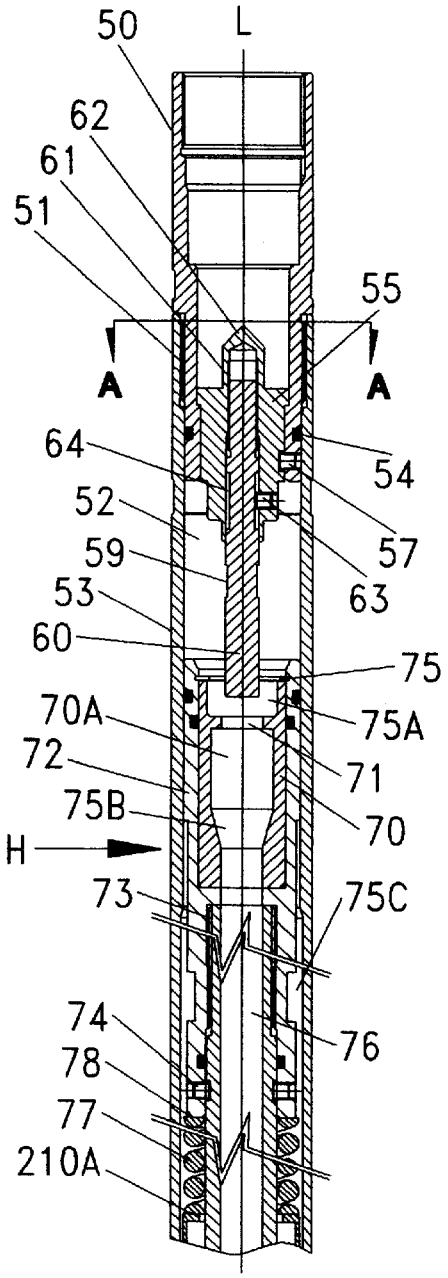
FIGS. 14*a*, 14*b*, 14*c*, and 14*d* are cross-sectional views of a controllably bent sub of the invention in the plane of the sub's bend containing the force limiting transmission means of the invention and illustrating sub terminal segment deflection at high fluid flow.
Figure 14B:
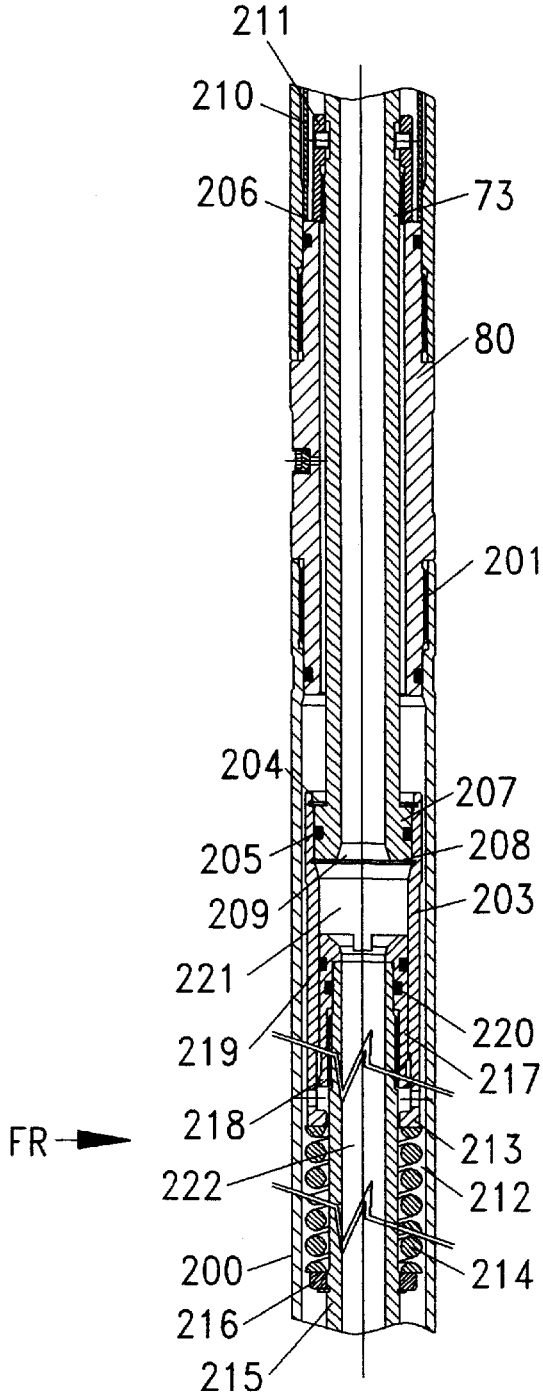
Figure 14C:
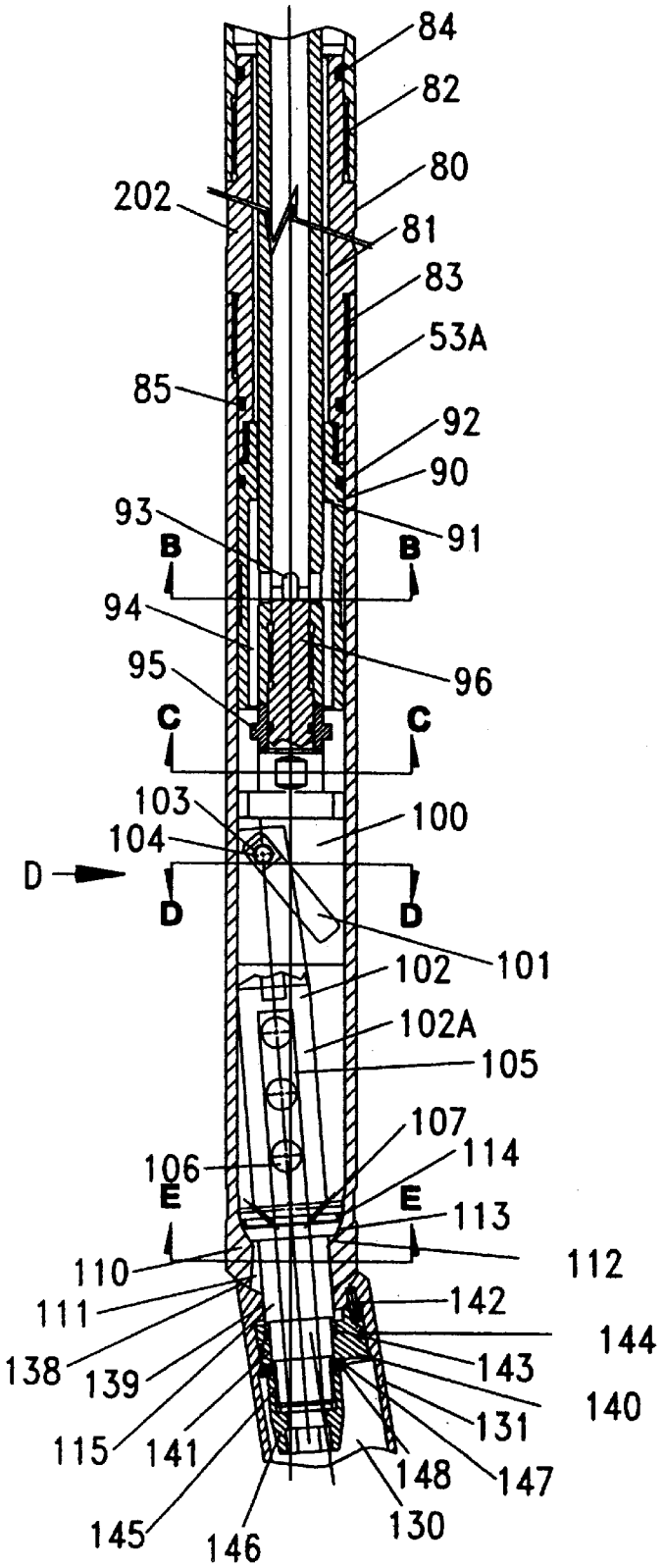
Figure 14D:
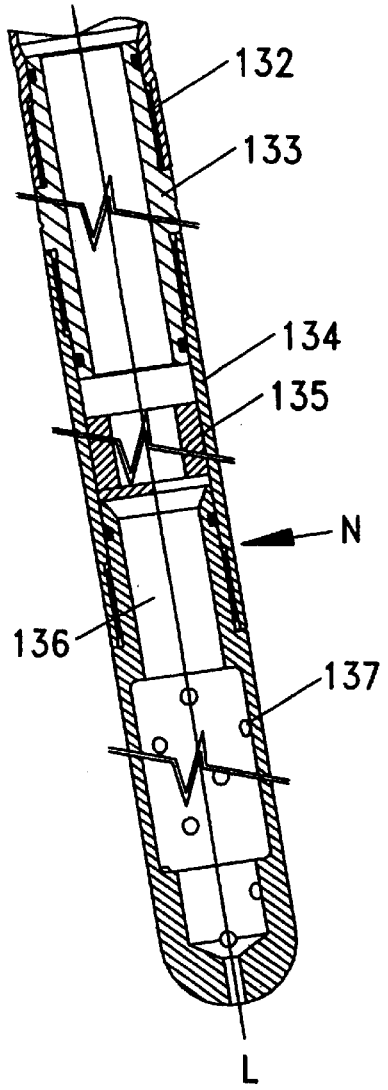

If the fluid flow rate is below that which generates sufficient hydraulic force to overcome the spring 77, the rod 60 will remain inside the orifice 71. The hydraulic force actuating the cam mechanism is then a function of the small annular flow passage between the orifice 71 and rod member 60. FIG. 11 illustrates the displacement of mandrel 73 and the relative positions of the mandrels 73 and 215 in this circumstance. If the flow is increased, causing the piston H and mandrel 73 to be displaced in housing 53 away from section 50, the orifice will translate with mandrel 73 and remain in loose proximity to rod 60, similar to the position illustrated in 4*a*. However, the mandrel 73 and the mandrel 215 are displaced longitudinally in housing 53 as a single entity, causing deflection of the segment N. This circumstance is illustrated in FIGS. 14*b*, 14*c*, 14*d*.

At a high flow rate, e.g., greater that 2 barrels per minute, the piston H moves longitudinally in housing 53, the orifice 71 clearing rod 60. The resultant increase of flow area reduces the relative pressure drop through piston H. The mandrel 73 moves longitudinally, compressing spring 77 and spring 214 and translating until the stop or shoulder 211 on mandrel 73 abuts the shoulder 206 of sleeve 80. As the mandrel 215 moves longitudinally, the boss 95 moves to the position shown in FIG. 14*c*. That is, boss 95 (mounted on the mandrel 215) clears the end of sleeve 90 (fastened to the housing 53*a*). The pressure reduction when the tool is bent acts as a signal to the surface that the lateral has been entered. If the force on the piston H exceeds the preload force of spring 77, and spring 214 is compressed, mandrel 215 is released and decoupled from mandrel 73. The orifice rod position is as shown in FIG. 14*a*, the length of chamber 221 in FIG. 14*b* being reduced due to the displacement of the mandrel.

The decoupling of the second mandrel provides great advantage. As indicated previously, if the operator continues to pump at high flow rates, thereby generating sufficient force on the piston H to keep it advanced in the bore of the sub, decoupling of the mandrel 215 allows the angle $\alpha$ made by the segment N and the longitudinal axis L to be reduced, so that the segment N may be constrained without damage to the sub. Again, the spring 214 protects the cam mechanism from overload under high flow rate situations when the sub is straight or is being closed at high flow rate conditions.

Additionally, the boss 95 on mandrel 215 provides a valuable signaling function similar to that performed by 60 and 71 in the first sub. In particular, when the nose or tip 136 enters a lateral wellbore, the additional deflection of segment N, acting through the extension arm 115, pivot shaft 102, and slider 104 on the cam 100 and mandrel 215, opens up additional area for fluid flow past boss 95 (FIG. 14*c*), thereby resulting in a pressure reduction which may be sensed by suitable pressure measurement device and which is observable to an operator at the surface. This pressure drop provides an effective diameter threshold measurement or indicator at the position of the tip 136 in the main wellbore, indicating to the operator that the diameter of the bore exceeds the known main wellbore diameter, and, in the absence of a washout, signaling the location of a lateral.

If, after conducting the above described procedure, no pressure change is observed in the retrieve or advance, the tool is indexed, e.g., 30 degrees, the sub is returned to an appropriate position, and the above-described procedure may be repeated. Alternatively, the tool may be slowly rotated while moving the tool. This would achieve 360 degree spiral coverage and reduce fatigue on the coiled tubing and time required to locate the lateral in addition to simplifying the operation.

What is claimed is:

1. A segmented work-locator sub comprising an attaching sub segment adapted for attachment to a work string or tool at one end thereof; and a nose segment coupled to the attaching sub segment at the other end thereof, the attaching segment and the nose segment being coupled in such manner that the nose segment is semi-rigidly positioned so that its longitudinal axis coincides at least substantially with that of the attaching segment, or is semi-rigidly pivoted and positioned at an acute angle with respect to the longitudinal axis of the attaching segment, the nose segment being of a length adapted for lateral wellbore incursion and comprising means for well treatment.

2. The sub of claim 1, further comprising a structure for injection or egress of treating fluids.

3. The sub of claim 1, further comprising a structure for measurements in the well.

4. The sub of claim 1, further comprising a structure for analysis in the well.

* * * * *